US006827125B2

(12) United States Patent
Warren

(10) Patent No.: US 6,827,125 B2
(45) Date of Patent: Dec. 7, 2004

(54) CASTING FURNACE

(75) Inventor: David O. Warren, Cloverdale, CA (US)

(73) Assignee: Lectroltherm, Inc., Canton, OH (US)

( * ) Notice: Subject to any disclaimer, the term of this patent is extended or adjusted under 35 U.S.C. 154(b) by 0 days.

(21) Appl. No.: 10/251,027

(22) Filed: Sep. 20, 2002

(65) Prior Publication Data

US 2004/0055729 A1 Mar. 25, 2004

(51) Int. Cl.[7] ..... B22D 27/04; B22D 27/15
(52) U.S. Cl. ..... 164/258; 164/256; 164/338.1
(58) Field of Search ..... 164/122.1, 122.2, 164/338.1, 256, 257, 258

(56) References Cited

U.S. PATENT DOCUMENTS 3,895,672 A * 7/1975 King et al. ..... 164/65
4,541,475 A * 9/1985 Goddard et al. ..... 164/65
6,308,767 B1 * 10/2001 Hugo et al. ..... 164/122.1

* cited by examiner

*Primary Examiner*—Kuang Y. Lin
(74) *Attorney, Agent, or Firm*—Sand & Sebolt

(57) ABSTRACT

A casting furnace for use in melting and molding metals. The furnace has a mold insertion and withdrawal system attached thereto and incorporates an offset mold elevator for moving a mold up and down from a mold chamber to a furnace chamber while eliminating the need for a pit. The furnace further includes a readily removable chill plate on which the mold rides. An overhead material feed system is also provided.

28 Claims, 13 Drawing Sheets

CASTING FURNACE

BACKGROUND OF THE INVENTION

1. Technical Field

This invention relates to furnaces for use in melting and molding metals often referred to as casting. More particularly, this invention relates to a casting furnace incorporating a mold insertion and withdrawal system that operates adjacent to the mold and mold support thereby eliminating the need for a pit thereunder housing such a system. Specifically, the invention is a casting furnace with a mold insertion and withdrawal system attached thereto and incorporating an offset mold elevator for moving a mold from a mold loading chamber to a melt processing chamber while eliminating the need for a pit. The system further incorporates a readily removable chill plate on which the mold rides, and an overhead material feed system.

2. Background Information

Casting furnaces are used to melt metals such as chrome alloy, super alloy, titanium, and nickel-based castings or other like materials whereby the molten metals are poured into molds in the shape of the desired end product. This overall process is known as casting. During casting, one of the necessary operations is the insertion of the molds into the furnace prior to use, and the removal of the molds from the furnace after use.

A typical system for performing this process includes a furnace with a melt processing chamber coupled to a mold loading chamber whereby some form of a withdrawal cylinder is positioned directly under a plate or base that supports the mold. The plate is used to lift the mold into and out of the melt-processing chamber of the furnace. The withdrawal cylinder is a cylinder actuated in and out of an elevator tube positioned beneath the lowest point that the plate must actuate to during the use of the mold, whereby this elevator tube is positioned within a furnace pit where it extends into the pit and/or through a hole within the pit and into the ground or foundation on which the furnace sets, or into some form of an area below the furnace.

Although these systems operate generally in the intended manner, certain disadvantages and problems exist. First, the furnace may only be located where a pit or similar chamber beneath the furnace may be provided to house at least the elevator tube. Second, extra costs are incurred to build or modify such a building due to additional foundational costs associated with the pit requirement. Third, a pit is a confined space and thus it is difficult to maintain, improve, fix and/or operate the parts of the withdrawal cylinder and/or furnace positioned therein.

Furthermore, the withdrawal cylinder or elevator tube is very susceptible to major damage in the event of a mold breakout or overflow. This is particularly true since the cylinder is located directly under the mold or in close proximity to the mold whereby molten material during a breakout-or overflow contaminates substantially all parts positioned below the mold including the withdrawal cylinder or elevator tube. This contamination often causes significant damage to seals, housings, and other parts as well as requiring significant clean-up of the harden metal thereon or replacement of many parts of the system.

It is also noteworthy that the mold elevator shaft in current systems is typically a hydraulically actuated, precision ground and polished chrome design to satisfy the water cooling requirements. Such a design is expensive.

For these and other reasons, it is thus very desirable to provide an improved mold withdrawal system.

BRIEF SUMMARY OF THE INVENTION

The invention is an improved casting furnace with a pit-less mold insertion and withdrawal system incorporating an offset elevator, and the method of use thereof.

Specifically, the invention is a furnace for melting and pouring molten material into molds. The furnace includes a melt-processing chamber including a melting pot from which molten material may be poured. The furnace also includes a mold support on which a mold is seated, the mold support moveable vertically along a first axis into and out of the furnace chamber, and an elevator mechanism, offset from the first axis, for raising and lowering the mold support into and out of the melt processing chamber.

BRIEF DESCRIPTION OF THE DRAWINGS

Preferred embodiments of the invention, illustrative of the best modes in which the applicant has contemplated applying the principles, are set forth in the following description and are shown in the drawings and are particularly and distinctly pointed out and set forth in the appended claims.

Similar numerals refer to similar parts throughout the drawings.

DETAILED DESCRIPTION OF THE INVENTION

Figure 1:
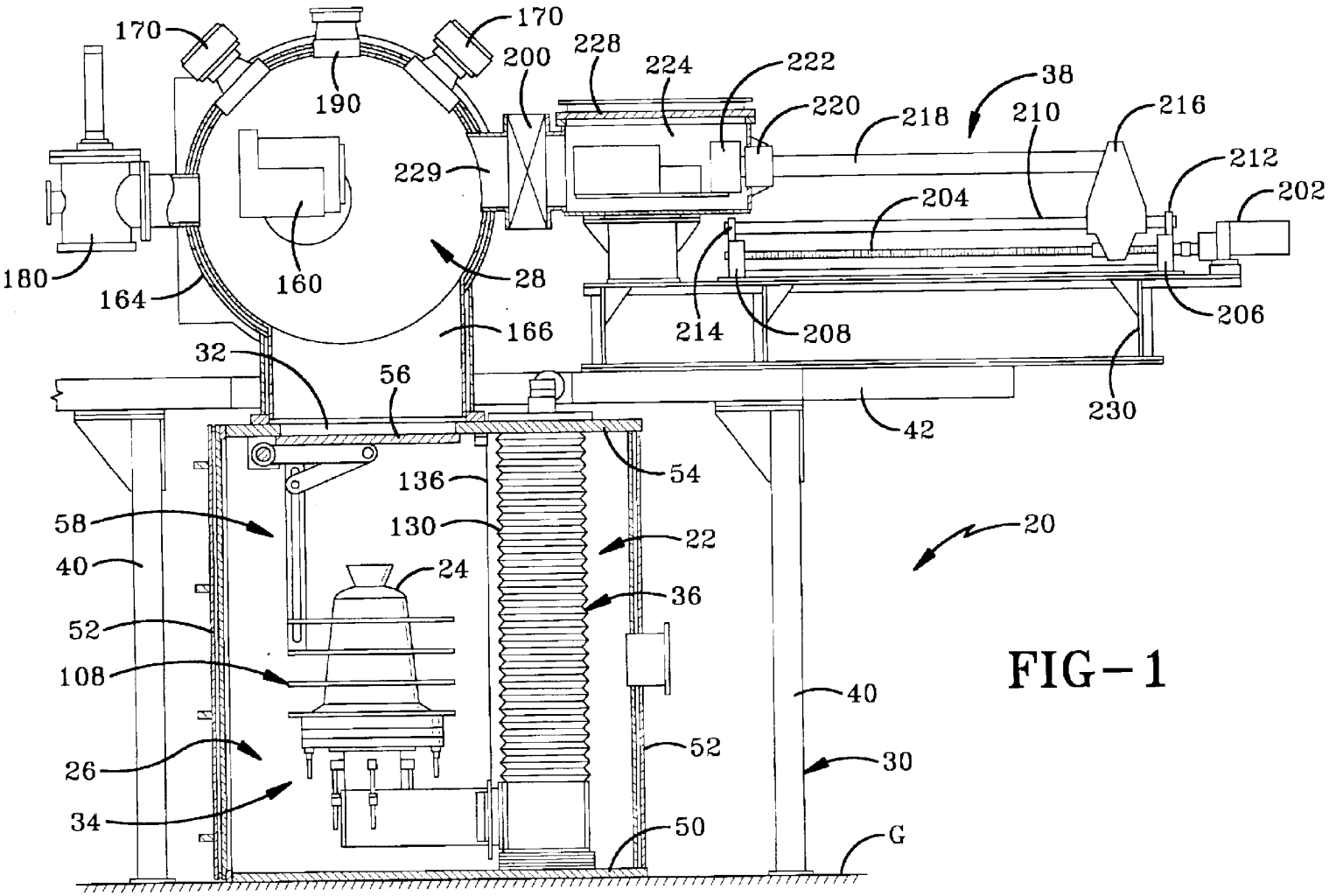
FIG. 1 is a front elevational view of the present invention of the furnace incorporating a mold chamber with an offset mold elevator therein with a chill plate thereon, a furnace chamber, and an overhead system for providing material to be melted.

An improved casting furnace for melting metal and pouring the molten metal into molds is the present invention as is shown in the Figures although other embodiments are contemplated as is apparent from the alternative design discussions herein and to one of skill in the art. Specifically, the described embodiment of the improved furnace is indicated generally at 20 as shown in FIGS. 1–13. This furnace is designed to be of a pit-less variety whereby a mold insertion and withdrawal system 22 moves a mold 24 from a mold loading chamber 26 into and out of a melt processing or furnace chamber 28. Overall, the furnace 20 includes a frame 30 including legs 40 and cross supports 42, the mold loading chamber 26 and the melt processing chamber 28 with an access passage 32 therebetween, the mold insertion and withdrawal system 22 including a mold support 34 vertically moveable within the mold loading chamber 26 by a drive system 36, and an overhead material provider 38 which includes a melt charge feeder chamber, a melt induction coil, a melt power supply, various vacuum components, and controls.

Frame 30 is a standard rigid structure of sufficient strength and rigidity to support the melt-processing chamber 28, which is positioned on cross supports 42. Frame may be any design, construction or configuration made out of any material that is sufficient to allow it to support the furnace 20, the overhead material provider 38 and any material therein, as well as a mold substantially filled with a molten load. Frame 30 and mold loading chamber 26 are positioned on the ground G which may be a factory floor. There are no pits or other cavities within the floor for housing any portion of the furnace or any mold insertion or withdrawal system.

Mold loading chamber 26 defines an enclosed compartment or environment in which the mold 24 is inserted to be processed. In one embodiment, the mold loading chamber 26 is a square or similar shaped box-like structure with a plurality of sides including a bottom 50, ends 52 including one of which may include an access door, and a top 54. As noted an access door is provided in one of the ends to move the mold into and out of the entire system. In addition, a valve gate 56 is defined in access passage 32 of top 54. A valve gate open and close mechanism 58 opens and closes the valve gate 56 when desired. Valve gate mechanism 58 includes a first pivot rod 60, a first arm 62, a second pivot rod 64, a second arm 66, a third pivot rod 68 and an elongated bar 70 with an elongated slot 72 therein.

Figure 10:
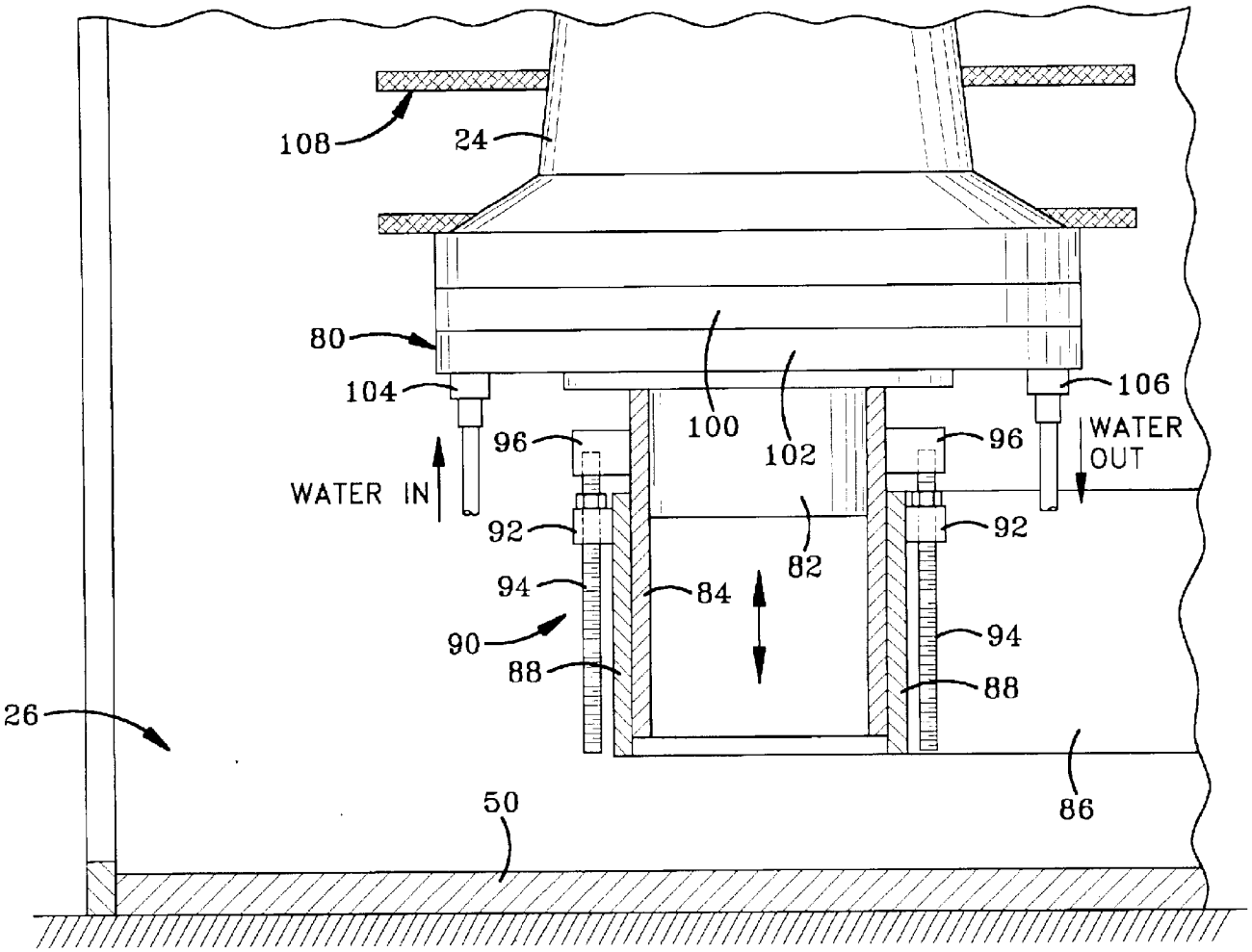
FIG. 10 is the same enlarged view as FIG. 9 of the quick-change chill plate and the seat it seats within except the plate is seated and coolant hoses are connected.
Figure 11:
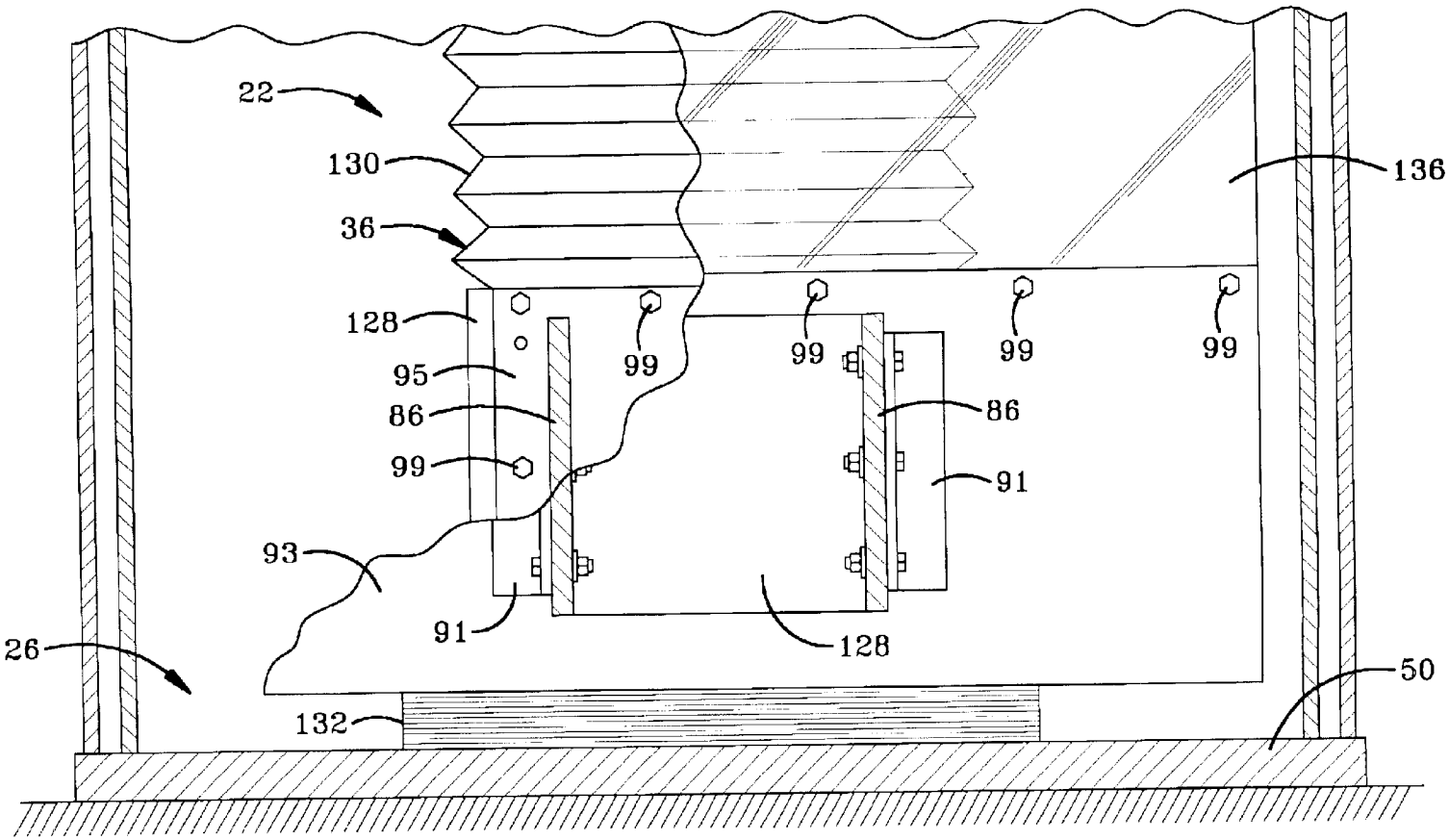
FIG. 11 is an enlarged partial sectional view taken along line 11—11 in FIG. 6.

In accordance with one of the features of the invention, the mold insertion and withdrawal system 22 includes mold support 34 on which mold 24 sits all of which is offset from the drive system 36 that moves the mold vertically within the mold loading chamber 26 into the furnace chamber 38. Specifically, as best shown in FIG. 10 mold support 34 includes a chill plate 80 with a seating ring 82 on the bottom surface thereof defining an outer diameter, a hollow cylindrical seat 84 defining an inner diameter capable of receiving the outer diameter of the seating ring 82 therein, and a bracket 86 with a first end 88 capable of securing the seat 84 therein and a second end 89 securable to a collar as defined below of drive system 36 by brackets 91, plates 93 and 95, optional spacers 97 and bolts 99. The mold support 34 may also include a height adjuster 90 including threaded bushings 92 secured to the bracket 86, threaded rods 94 threadably adjustable within the bushings 92, and a plate 96 secured to the upper ends of the rods 94 so as to be adjustably moveable upward to provide a higher stop for the mold 24 to sit on than the top rim of the seat 84 although the ring 82 will still be aligned partially within the seat. The height adjuster is also usable as a balancer whereby one or more, but less than all, of the multiple threaded rods are adjusted through the threaded bushings resulting in a tilting action of the plate 96 which once above the top rim of the seat 84 provides a more properly balanced or level seat.

The chill plate 80 is a cooling plate, which may be of a variety of designs. In the embodiment shown, the chill plate 80 is an upper plate 100 sandwiched together with a lower plate 102 whereby at least one channel is defined therebetween to receive cooling or chilled fluid. Specifically, the lower plate 102 includes a fluid entrance fitting 104 and a fluid exit fitting 106 with a fluid ports extending into the lower plate to a fluid passage extending therebetween in the mated area between the lower and upper plates. These fluid fittings and ports receive the cooling or chilled fluid such as water or another coolant.

The chill plate 80 is interchangeable with over chill plates by a quick disconnecting of fluid hoses from the fittings 104 and 106 followed by a lifting of the chill plate 80 and specifically its seating ring 82 from the hollow cylindrical seat 84. A different chill plate is then seated onto the seat 84, and the fluid hoses are connected to the fittings on the new chill plate.

A baffle system 108 is provided into the chill spool assembly. The baffle system includes a plurality of baffles that readily allow for in process changing thus enabling the use of a conformal design. This equates to tightly baffled parts that minimize diagonal view factors thus resulting in maximized temperature gradient and enhanced process control. In an alternative embodiment, stacked baffles may be also be used.

Drive system 36 of the mold insertion and withdrawal system 22 is an offset mold elevator that in the embodiment shown is of a ball bushing track and ball screw drive design. Specifically, as best shown in FIGS. 2–6, the drive system 36 holds the mold support 34 so as to move a mold thereon up and down within the mold chamber 26. The drive system 36 includes a top plate 110, a bottom plate 112, a ball screw 114, an upper guide mount 116, a lower guide mount 118, a ball follower 120, a center plate 122, a plurality of guide rods 124, I-beam support plates 126, a collar 128, upper bellows 130, lower bellows 132, multiple slidable guides 134, a shade or water-cooled sliding-way cover 136, and a drive motor 138.

Ball screw 114 is drivably attached to drive motor 138 and is seated at each end in central apertures in top plate 110 and bottom plate 112, respectfully, and extends therebetween. Guide mounts 116 and 118 secure the ball screw 114 in place while allowing it to rotate in central apertures in top plate 110 and bottom plate 112, respectfully, as driven by drive motor 138 connected approximate the top plate 112. The guide mounts 116 and 118 include an internal cylindrical passage with bearings, bushings and/or seals to allow the ball screw (not threaded at the ends where the mounts are located) to freely rotate, while the area in between the mounts is threaded thereby driving the ball follower 120 when the ball screw 114 is rotated by the drive motor.

Figure 7:
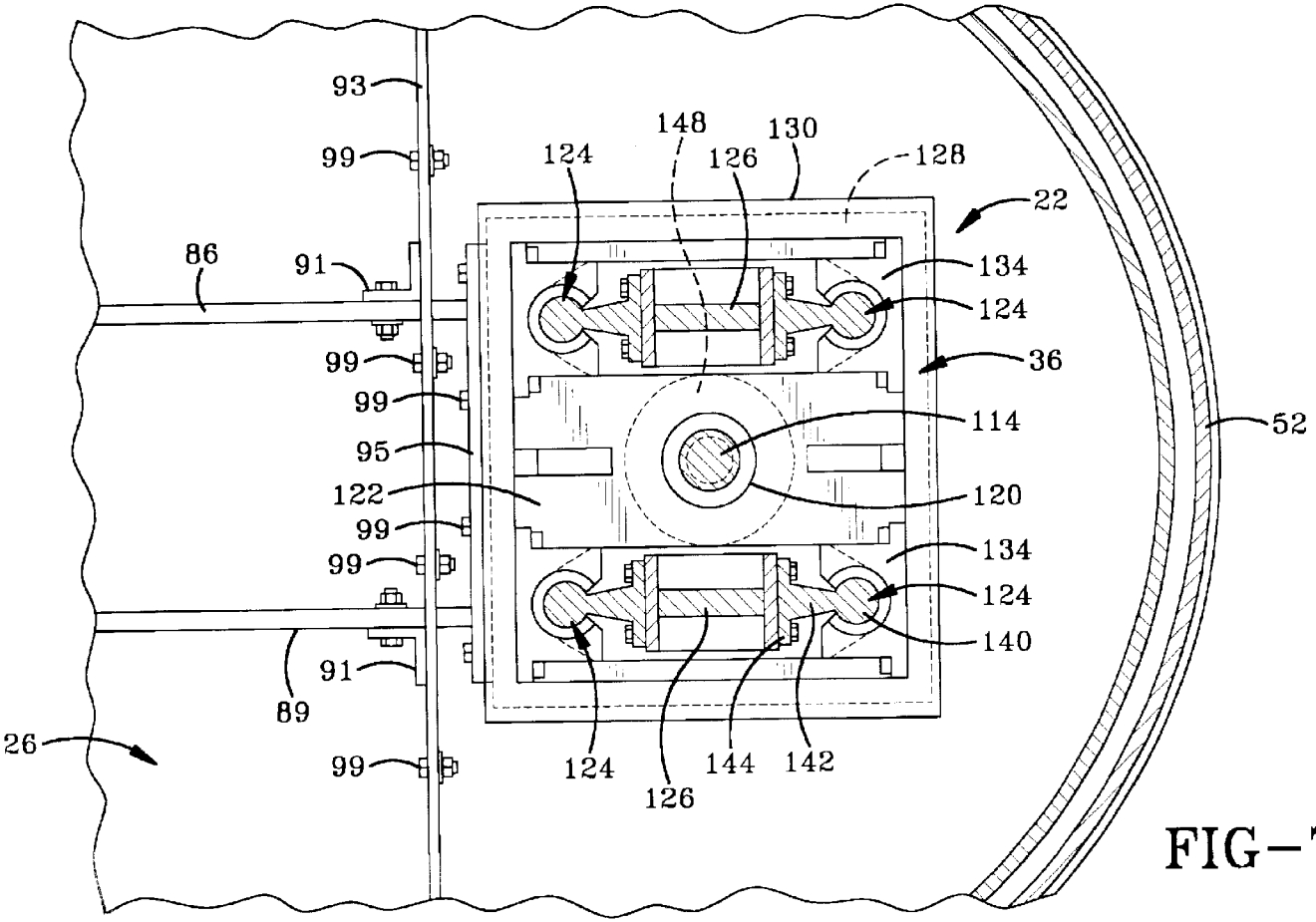
FIG. 7 is an enlarged sectional view taken along line 7—7 in FIG. 6.
Figure 8:
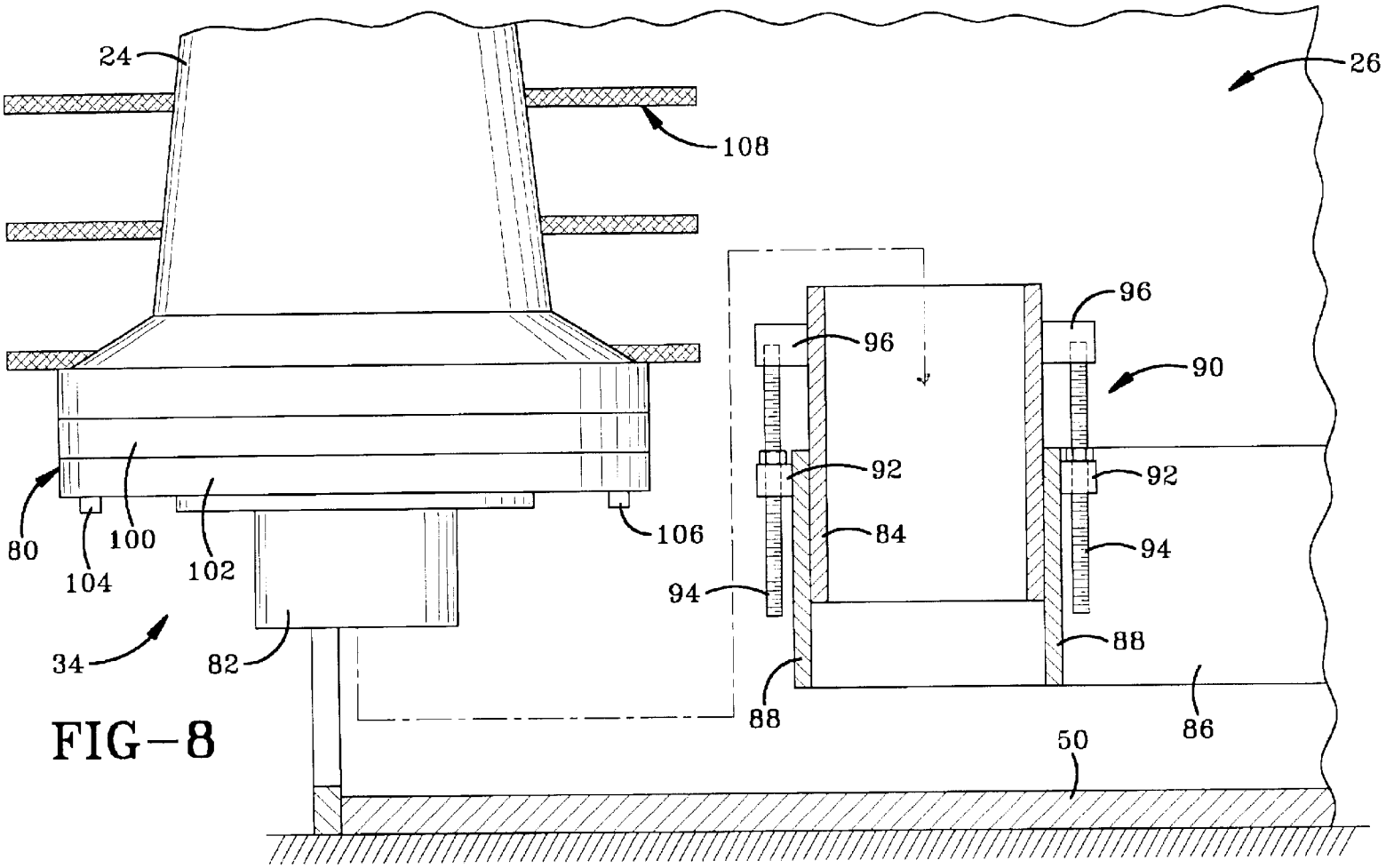
FIG. 8 is an enlarged view of the quick-change chill plate and the seat it seats within where the plate is unseated.
Figure 9:
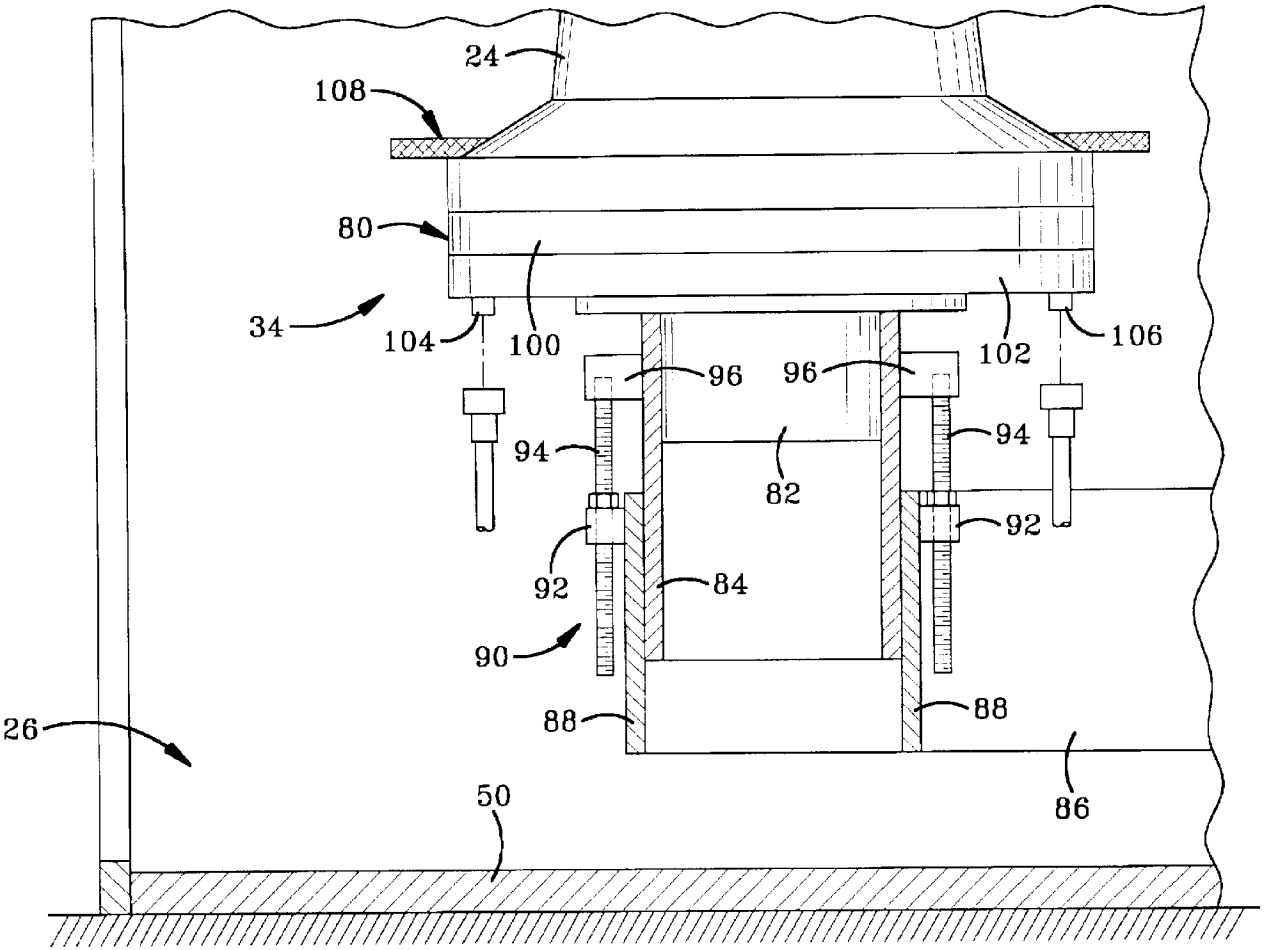
FIG. 9 is the same enlarged view as FIG. 8 of the quick-change chill plate and the seat it seats within except the plate is seated but coolant hoses are not connected.

In the embodiment shown, the plurality of guide rods 124 total four and are equally disbursed around the ball screw 114 as best shown in FIG. 7. As shown, each of the guide rods 124 includes a cylindrical portion 140, an elongated neck portion 142, and an elongated planar plate 144. The guide rods 124 are grouped into two pairs, where each pair is connected together by I-beam support plates 126 as shown in FIG. 7. These guide rods provide for smooth and balanced movement of the ball screw and attached mold support 34.

Ball follower 120 includes a threaded inner passage that is threaded onto the ball screw 114. Ball follower also includes a disk that extends outward and defines a ledge 148.

Figure 4:
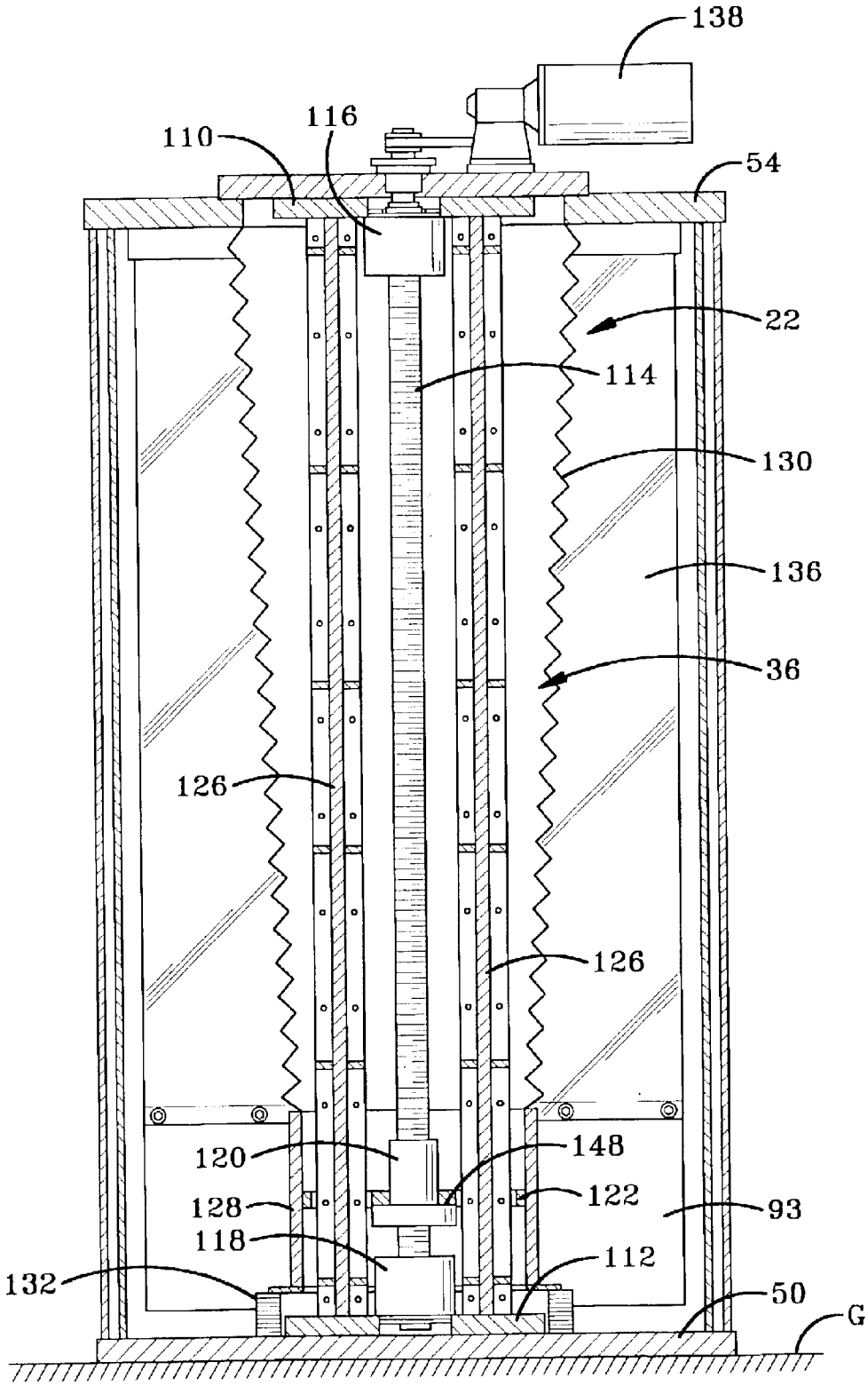
FIG. 4 is an enlarged sectional view taken along line 4—4 in FIG. 3 of the offset ball bushing track and ball screw drive system in the chamber shown in FIGS. 2 and 3.
Figure 5:
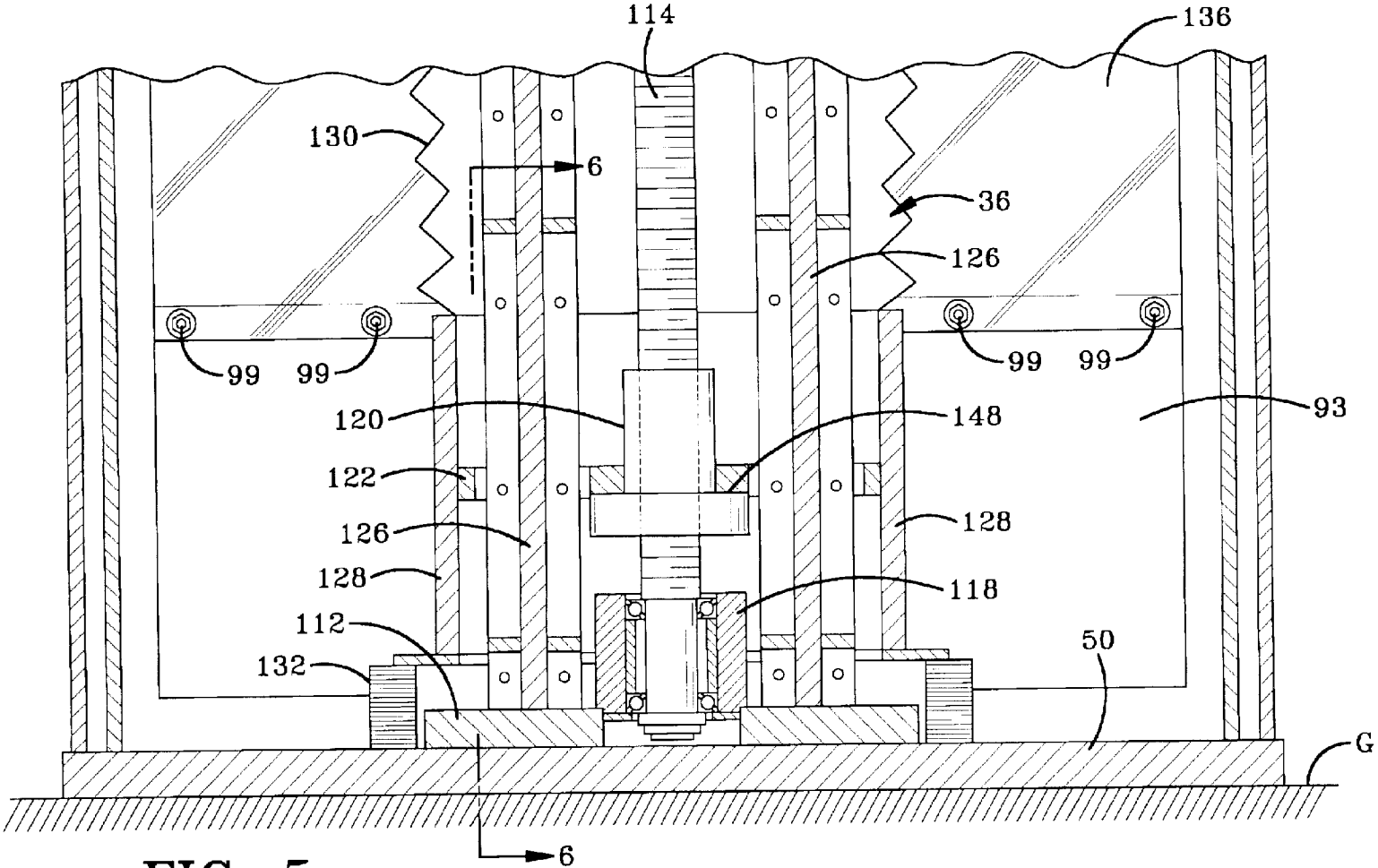
FIG. 5 is an enlarged view of the bottom portion of the offset ball bushing track and ball screw drive system in the chamber shown in FIG. 4.

Center plate 122 is connected to and/or rides on ledge 148 of the ball follower 120 such that movement of the ball follower up and down causes movement of the plate 122. Collar 128 is connected to the plate 122 as best shown in FIG. 4 whereby the collar is rigidly connected to the second end 89 of the bracket 86 of the mold support 34. As a result, any movement of the ball screw 114 is directly correlated to the ball follower 120, center plate 122, collar 128, bracket 86, seat 84, ring 82, chill plate 80 and thus the mold 24 seated thereon.

Figure 6:
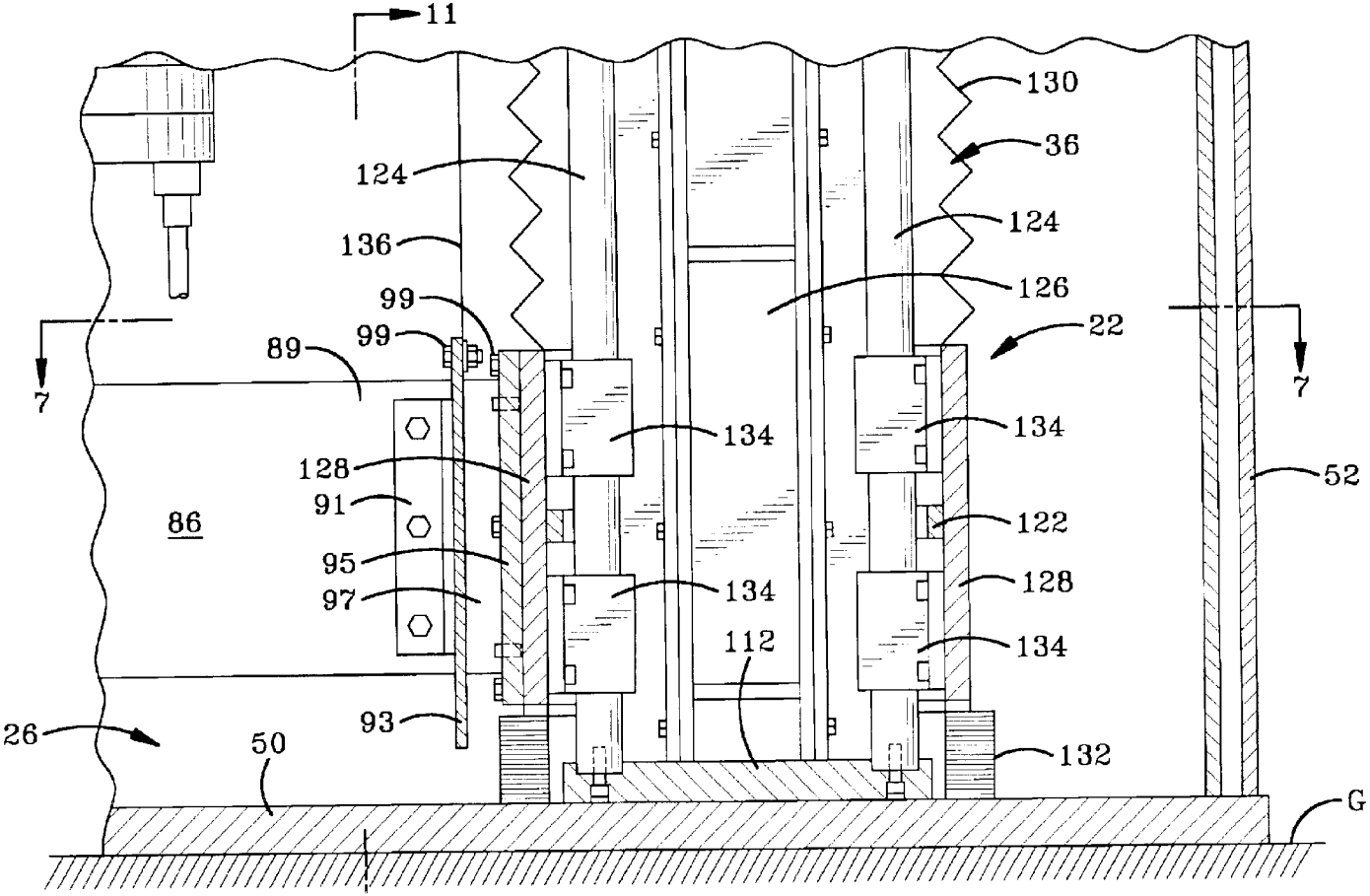
FIG. 6 is an enlarged sectional view taken along line 6—6 in FIG. 5.

Multiple slidable guides 134 as best shown in FIG. 6 assist the collar 128 in maintaining proper alignment with the ball follower 120. The upper bellows 130 extend from the top plate 110 to the collar 128, and the lower bellows 132 extend from the collar 128 to the bottom plate 112, and both bellows function to enclose the ball screw system for safety reasons.

Cover 136 is preferably transparent and attached to the collar 128 or bracket 86 so as to slide therewith. This cover is provided for safety reasons as well as to protect the drive screw and associated parts from furnace dust and debris. The cover, which is water-cooled, also protects the drive screw from heat given off from the hot mold.

Melt processing chamber 28 defines an enclosed compartment or environment in which raw materials are melted so as to flow whereby the molten materials are poured into the mold 24 that is inserted into the furnace from mold chamber 26. More specifically, valve gate 56 as defined above is a gate selectively sealing access passage 32 of top 54 in mold loading chamber 26 thus selectively opening and closing a port or access between the mold loading chamber 26 and the melt processing chamber 28.

Within the melt processing chamber 28 is a melting furnace 160 that is movably mounted so as to be moveable to receive ingots from valve 200, and pivotally mounted so as to be able to pour molten material into the mold 24. The melting pot includes some form of heating element as is well known in the art. Ingots or other raw material bars are provided by overhead material provider 38 whereby these materials are melted in the melting furnace 160 via an induction coil located therearound. Once the materials are sufficiently molten, valve gate; 56 is opened and a mold 24 is elevated as described below such that the mold moves from the FIG. 1 position to the FIG. 12 position and is ready to receive the molten material by pivoting the furnace 160 to pour the material into the mold.

Melt processing chamber 28 as shown in one embodiment in the FIGURES is a cylindrical drum 164 laid on its side with a window 166 connected to the door 56. Melt processing chamber 28 also includes one or more view windows 170, a vacuum poppit valve 180, an access plug 190, and a valve 200 for controlling material flow. Valve 200 is a vacuum isolation valve that isolates the melt charge feeder 24 from the melt chamber 28.

The overhead material provider 38 is connected to the melt-processing chamber at valve 200. In addition to valve 200, provider 38 includes a motor 202, drive shaft or screw 204, supports 206 and 208, a guide rod 210, guide supports 212 and 214, a drive body 216, a drive cylinder 218, a sleeve 220, a feed spoon 222, a melt charge feeder chamber 224 with a door 228 therein, a material passage or port 229 with a valve 200 therein, and a support frame 230.

Motor 202 is connected to drive shaft 204 so as to drive or turn the shaft within supports 206 and 208 which are affixed to frame 230 and contain bushings to allow for turning of the shaft therein. Guide rod 210 is affixed to guide supports 212 and 214 which are affixed to supports 206 and 208. Drive body 216 includes a threaded port receiving the threaded drive shaft 204 and another port receiving the smooth walled guide rod 210, whereby turning of the drive shaft 204 causes linear movement along the drive shaft by the drive body 216 which is further guided by the guide rod 210. Drive body 216 in turn drives drive cylinder 218, which is rigidly connected thereto, through sealable sleeve 220 such that head 222 on the opposite end of cylinder 218 drives ingots or the like into passage 229.

In operation, all external chamber doors and valves are closed. The desired vacuum is provided to the furnace. Valve 200 is closed. The vacuum within the melt charge feeder 224 is released, and door hatch 228 is opened so that melt charge material to be melted is loaded into the melt charge feeder chamber 224 on feed spoon 222. The door hatch 228 is closed, and a vacuum is returned to the melt charge feeder 224. Induction melt furnace 160 is tilted to a horizontal position and lined up with port 229. Valve 200 is then opened and melt charge is driven through the material port 229 and inserted into the melt furnace 160. Specifically, drive motor 202 drives screw 204 to turn causing drive body 216 to move thereby pushing drive cylinder 218 and feed spoon 222 on the opposite end thereof. The melt charge material is thus driven into the material port 228. Feed spoon 222 is then retracted and valve 200 closed. The melt furnace 160 is rotated into a vertical position. The induction power supply is turned on to melt the charge feed material. If necessary, some previous steps may be repeated to provide additional charge feed material to be melted.

Figure 2:
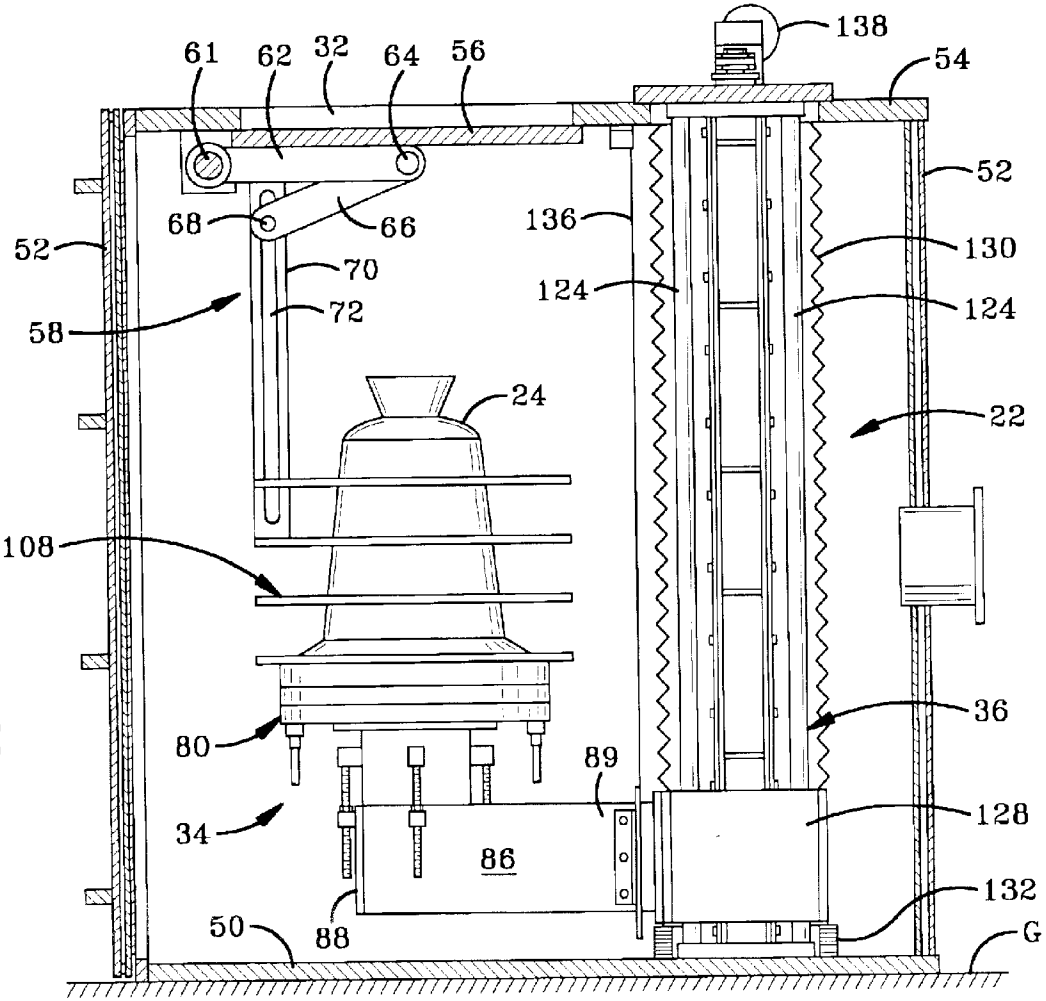
FIG. 2 is an enlarged front sectional view of the mold chamber portion of the invention as shown in FIG. 1.
Figure 3:
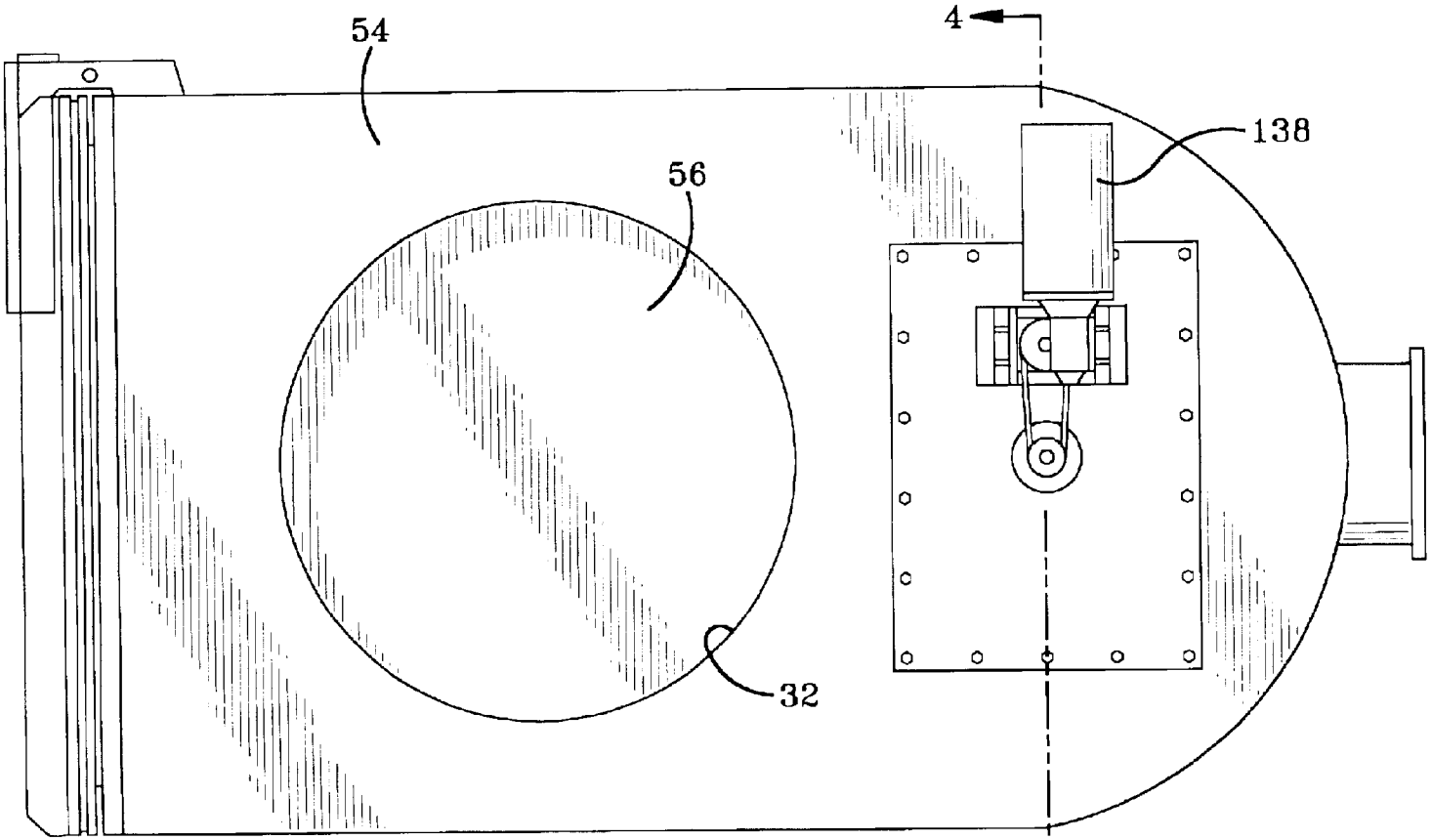
FIG. 3 is an enlarged top plan view of the mold chamber portion of the invention as shown in FIG. 2.
Figure 12:
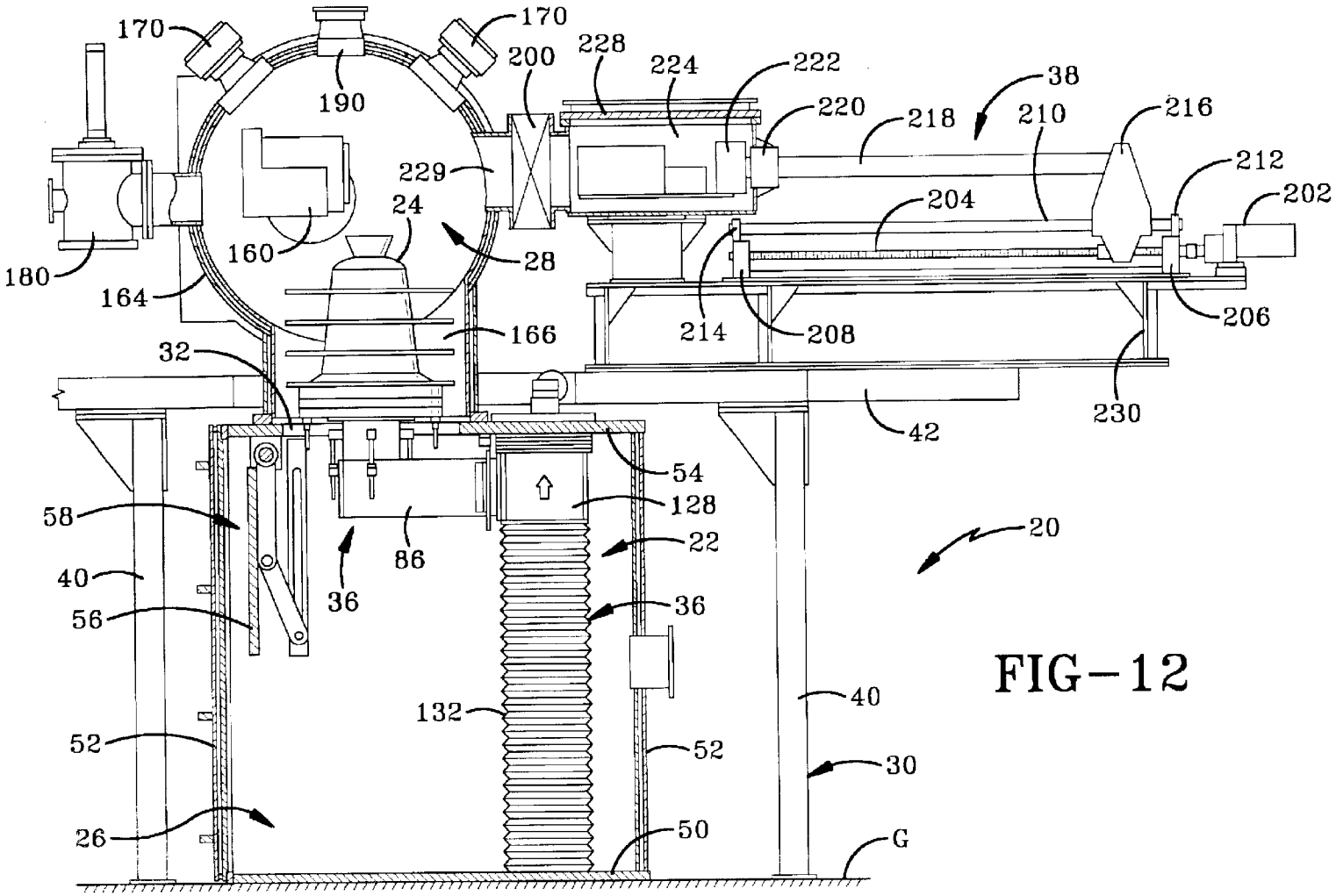
FIG. 12 is the front elevational view of the present invention as shown in FIG. 1 except the mold is elevated into the furnace chamber.
Figure 13:
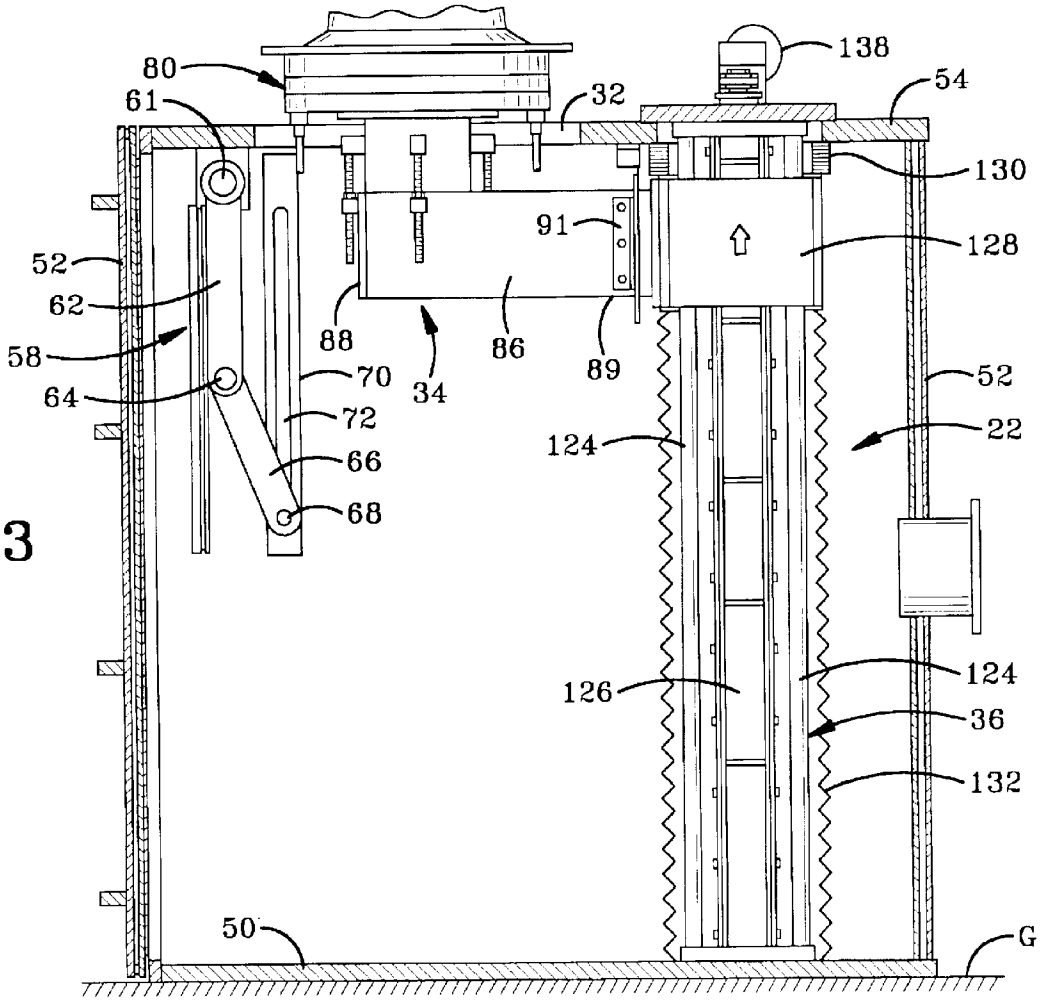
FIG. 13 is the same front sectional view of the mold chamber portion of the invention as shown in FIG. 2 except the mold is elevated as in FIG. 12.

Either in parallel with the above process or in sequence after, a mold is provided. Specifically, valve gate 56 is closed or verified to be closed. The vacuum in the mold-loading chamber 26 is released. Mold loading chamber door 52 is opened to allow insertion of a mold 24 into the chamber 26. Once the mold is inserted and properly placed in the chamber on mold table 80, the door 52 is closed and the vacuum returned. Once the melt charge is melted and casting is desired, valve gate 56 is opened. This occurs via valve gate open and close mechanism 58. First pivot rod 60 is driven to turn or pivot by a motor. This causes first arm 62 to pivot clockwise on FIG. 2 which pushes the second pivot rod 64 and attached second arm 66 downward such that third pivot rod 68 slides in elongated slot 72 in elongated bar 70. All of this motion causes valve gate 52, which is connected to first arm 62, to open by pivoting downward to the position shown in FIG. 12. The mold 24 may now, be moved into the chamber 28. Motor 138 drives drive screw 114 to rotate causing ball follower 120 that is threaded thereon to move. Any movement of the ball screw 114 is directly correlated to the ball follower 120, center plate 122, collar 128, bracket 86, seat 84, ring 82, chill plate 80 and thus the mold 24 seated thereon. Upward driving of the drive screw 114 causes the mold to move upward into the chamber as shown in FIG. 12. Specifically, the motor 138 drives drive screw 114 to rotate causing ball follower 120 that is threaded thereon to move. Thus the hot mold is moved into the melt chamber into a casting position. Melt furnace 160 is titled at a controlled rate to cause pouring of the molten melt charge into the mold 24. The mold elevator 36 is retracted by a downward driving of the drive screw 114 that causes the mold to move downward back into the mold loading chamber 26 as shown in FIG. 2. Valve gate 56 is then closed by a reverse action that was used to open it. Thereafter, the mold may be removed by breaking the vacuum, and opening the mold loading chamber door 52. The mold is removed, and the entire process may be repeated non-stop until the end of a melt campaign, or a shut down for maintenance or other reasons.

Accordingly, the pit-less mold withdrawal system incorporating an overhead trolley is simplified, provides an effective, safe, inexpensive, and efficient device which achieves all the enumerated objectives, provides for eliminating difficulties encountered with prior devices, and solves problems and obtains new results in the art.

In the foregoing description, certain terms have been used for brevity, clearness and understanding; but no unnecessary limitations are to be implied therefrom beyond the requirement of the prior art, because such terms are used for descriptive purposes and are intended to be broadly construed.

Moreover, the description and illustration of the invention is by way of example, and the scope of the invention is not limited to the exact details shown or described.

Having now described the features, discoveries and principles of the invention, the manner in which the pit-less mold withdrawal system incorporating an overhead trolley is constructed and used, the characteristics of the construction, and the advantageous, new and useful results obtained; the new and useful structures, devices, elements, arrangements, parts and combinations, are set forth in the appended claims.

What is claimed is:

1. A casting furnace for melting and pouring molten material into molds, the furnace comprising:

a melt processing chamber including a melting pot from which molten material may be poured; and a mold loading chamber housing a mold support on which a mold is seated, and an offset drive assembly for raising and lowering the mold support into and out of the melt processing chamber; the drive assembly including a rotatable ball screw and a ball follower engaging the ball screw whereby rotation of the ball screw moves the follower to raise and lower the mold support.

2. The furnace of claim 1 wherein the mold support and the offset drive assembly operate side by side.

3. The furnace of claim 1 wherein the mold support and the offset drive assembly are adjacent one another.

4. The furnace of claim 1 wherein a collar is moved by the follower and the mold support is attached to the collar.

5. The furnace of claim 1 wherein the mold loading chamber is an enclosed compartment with the offset drive assembly extending from a top of the enclosed compartment to a bottom of the enclosed compartment adjacent to the mold support which is moveable vertically within the enclosed compartment.

6. The furnace of claim 4 wherein the offset drive assembly is fully inclosed by one or shades and the collar.

7. The furnace of claim 6 wherein the mold loading chamber is an enclosed compartment with the offset drive assembly extending from a top of the enclosed compartment to a bottom of the enclosed compartment adjacent to the mold support which is moveable vertically within the enclosed compartment, and further wherein the one or more shades include a first shade extending from the top of the enclosed compartment to the collar and a second shade extending from the bottom of the enclosed compartment to the collar.

8. The furnace of claim 4 wherein a plurality of guide rods support and guide the collar up and down along the ball screw.

9. The furnace of claim 1 wherein the mold support includes a removable chill plate seated on a bracket connected to a collar actuatable by the ball screw via the ball follower, the chill plate providing a seat for the mold.

10. The furnace of claim 1 wherein the ball screw includes a plurality of unthreaded portions which are mounted with respective bearings to facilitate rotational movement of the ball screw.

11. The furnace of claim 1 wherein the drive assembly includes a plurality of guide rods to facilitate smooth and balanced movement of the mold support.

12. The furnace of claim 11 wherein the mold support is mounted on the guide rods via a plurality of slidable guides which respectively slidably engage the guide rods to help maintain proper alignment of the mold support with the follower.

13. The furnace of claim 12 wherein a collar is connected to the slidable guides whereby the mold support is mounted on the slidable guides via the collar.

14. The furnace of claim 13 wherein the collar surrounds the ball screw, the guide rods and the slidable guides.

15. The furnace of claim 1 wherein the mold support includes a leveling mechanism for leveling the mold.

16. The furnace of claim 1 wherein at least one shade is disposed adjacent the drive assembly to protect the drive assembly from furnace dust and debris.

17. The furnace of claim 16 wherein the at least one shade is water-cooled to protect the drive assembly from heat given off from the mold when the mold is hot.

18. The furnace of claim 1 wherein an upper bellows and a lower bellows enclose the ball screw and ball follower.

19. The furnace of claim 18 wherein a collar is moved by the follower and the mold support is attached to the collar; wherein the mold loading chamber has a top and a bottom; and wherein the upper bellows extends between the collar and the top of the mold loading chamber and the lower bellows extends between the collar and the bottom of the mold loading chamber.

20. The furnace of claim 1 wherein the furnace is free of a mechanism for laterally adjusting the mold.

21. The furnace of claim 1 wherein the drive assembly provides smooth raising and lowering movement of the mold support.

22. A casting furnace for melting and pouring molten material into molds, the furnace comprising:

a melt-processing chamber including a melting pot from which molten material may be poured;

a mold support on which a mold is seated, the mold support moveable vertically along a first axis into and out of the melt-processing chamber; and an elevator mechanism, offset from the first axis, for raising and lowering the mold support into and out of the melt-processing chamber; the elevator mechanism including a rotatable ball screw with a ball follower actuatable up and down on the ball screw to raise and lower the mold support.

23. The furnace of claim 22 wherein the mold support and the offset elevator mechanism are adjacent one another.

24. The furnace of claim 22 wherein a collar is moved by the follower and the mold support is attached to the collar.

25. The furnace of claim 22 wherein the elevator mechanism is disposed within a mold loading chamber; and wherein the mold loading chamber is an enclosed compartment with the offset elevator mechanism extending from a top of the enclosed compartment to a bottom of the enclosed compartment adjacent to the mold support which is moveable vertically within the enclosed compartment.

26. The furnace of claim 22 wherein the offset elevator mechanism is fully enclosed by one or more shades and a collar attaching the mold support to the ball follower.

27. The furnace of claim 26 wherein the elevator mechanism is disposed within a mold loading chamber; and wherein the mold loading chamber is an enclosed compartment with the offset elevator mechanism extending from a top of the enclosed compartment to a bottom of the enclosed compartment adjacent to the mold support which is moveable vertically within the enclosed compartment, and further wherein the one or more shades include a first shade extending from the top of the enclosed compartment to the collar and a second shade extending from the bottom of the enclosed compartment to the collar.

28. The furnace of claim 22 wherein the mold support includes a removable chill plate seated on a bracket connected to a collar actuatable by a drive screw, the chill plate providing a seat for the mold.

* * * * *

UNITED STATES PATENT AND TRADEMARK OFFICE

CERTIFICATE OF CORRECTION

PATENT NO. : 6,827,125 B2
DATED : December 7, 2004
INVENTOR(S) : David O. Warren It is certified that error appears in the above-identified patent and that said Letters Patent is hereby corrected as shown below:

Title page,
Item [73], Assignee, change "Lectroltherm, Inc." with -- Lectrotherm, Inc. --

Signed and Sealed this

Third Day of May, 2005

JON W. DUDAS
*Director of the United States Patent and Trademark Office*